US008182166B2

(12) United States Patent
Colman

(10) Patent No.: US 8,182,166 B2
(45) Date of Patent: May 22, 2012

(54) BUTTERFLY FLIP PEN

(76) Inventor: Laurence Colman, Portland, OR (US)

( * ) Notice: Subject to any disclaimer, the term of this patent is extended or adjusted under 35 U.S.C. 154(b) by 916 days.

(21) Appl. No.: 12/186,685

(22) Filed: Aug. 6, 2008

(65) Prior Publication Data

US 2010/0034575 A1 Feb. 11, 2010

(51) Int. Cl.
*B43K 23/02* (2006.01)

(52) U.S. Cl. ..... 401/131; 401/6; 401/52; 401/99; 401/195

(58) Field of Classification Search ..... 401/6, 52, 401/95, 99, 131, 195; D19/41
See application file for complete search history.

(56) References Cited

U.S. PATENT DOCUMENTS 4,081,217 A * 3/1978 Klaber ..... 401/131
4,149,812 A * 4/1979 Huffman, Jr. ..... 401/6
6,464,419 B1 * 10/2002 Chan ..... 401/131

* cited by examiner

*Primary Examiner* — Tuan Nguyen
(74) *Attorney, Agent, or Firm* — Patent Forge LLC

(57) ABSTRACT

A folding pen with two handle sections and a body is disclosed where the handle sections are attached to the body at hinges and rotate between two positions. The first closed position may cover the body and the second open position may reveal the body providing a writing implement with a pen point and a handle.

18 Claims, 4 Drawing Sheets

Section CC

BUTTERFLY FLIP PEN

BACKGROUND

This disclosure relates to writing instruments and specifically to ink pens that resemble a folding knife. Other references disclosing ink pens that fold include U.S. Design Pat. D498,259 and U.S. Pat. Nos. 4,081,217; 4,149,812 and 6,464,419.

SUMMARY

Pens for writing are in constant demand and are produced in many varieties and large quantities. Pens have a limited life and may be lost, broken or exhaust their ink supply. There is always a need for new pens and a demand for new varieties of pens. This disclosure will describe a novel pen configured to function in a similar manner as a folding or butterfly knife. Butterfly knives have left and right handle sections that are connected by hinges to a blade.

The two parts of the handle in a folded or closed position cover the blade. Rotating the two handle sections about the hinges to an unfolded or open position exposes the blade and forms a knife handle.

In this description a pen body may replace the blade. The pen body may include an ink reservoir and a pen point for dispensing ink from the reservoir. In the closed position the pen point will be covered to prevent accidental ink stains on clothes or elsewhere. In the open position the handle sections and pen body will form an elongate body configured for writing by hand.

For the purpose of this description the word adjacent or adjacent position in relation to the handle sections will mean that the longitudinal axes of the handle sections are parallel and the handle sections are side by side, and if not touching, are proximate.

A folding pen will be described comprising an elongate body with a pen point for dispensing ink from a reservoir at a first end and a first hinge and a second hinge at a second end. The pen may include a right handle section attached to the elongate body by the first hinge and a left handle section attached to the elongate body by the second hinge where the right handle section pivots about the first hinge and the left handle section pivots about the second hinge. The handle sections may be moved between a first position with the right and the left handle sections adjacent to each other obscuring the elongate body, and a second position with the right and the left handle sections adjacent to each other exposing the elongate body and the pen point.

A folding pen will also be described comprising a body with a distal end and a proximal end, a first hinge at the distal end, a second hinge adjacent to the first hinge at the distal end, and a pen point for writing extending from the body at the proximal end. The pen may further comprise a first handle section with a proximal end and a distal end and a second handle section with a proximal end and a distal end where the first handle section proximal end is connected to the body at the first hinge and the second handle section proximal end is connected to the body at the second hinge. The first handle section pivots about the first hinge and the second handle section pivots about the second hinge moving between a closed position with the first and second handle sections covering the body and an open position with the first and second handle sections forming a grip section or an extension to the body.

DESCRIPTION

Figure 1A:
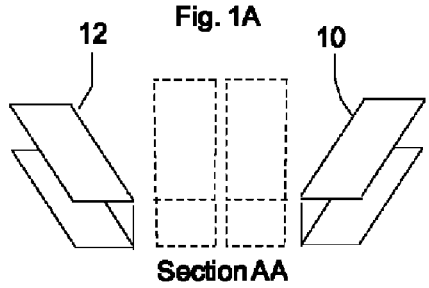
FIG. 1A is a cross section view of section AA of FIG. 1.
Figure 1:
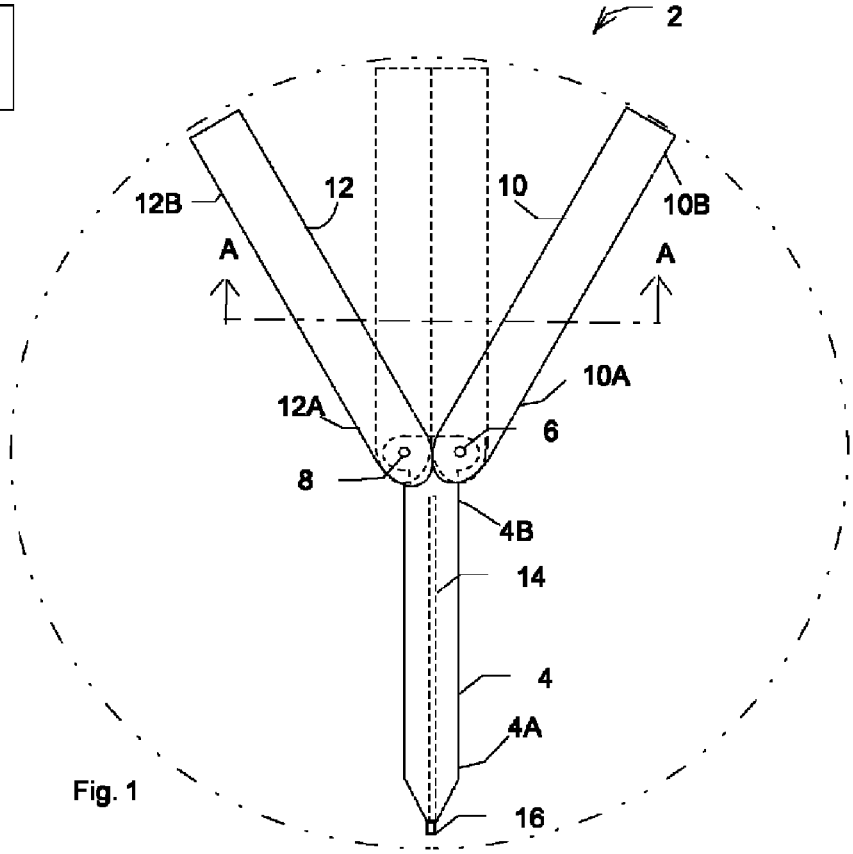
FIG. 1 is a front view of a folding pen showing a body and handle sections that pivot to move between open and closed positions.

FIG. 1 shows a front view of a pen 2 that includes a body 4 with a proximal end 4A and a distal end 4B, a first hinge 6 and a second hinge 8, both at distal body end 4B, a first handle section 10 and a second handle section 12. First handle section 10 may be longitudinal with a first or proximal end 10A and a second or distal end 10B. Second handle section 12 may also be longitudinal with a first or proximal end 12A and a second or distal end 12B. Proximal end 10A of first handle section 10 is attached to first hinge 6, and proximal end 12A of second handle section 12 is attached to second hinge 8 such that first and second handle sections 10 and 12 may be rotated about their respective hinges 6 and 8 to move between open and closed positions. Pen body 4 may further include an ink reservoir 14. Pen body proximal end 4A may include a pen point 16 that dispenses ink from connected reservoir 14.

FIG. 1A is a cross section view of section AA from FIG. 1 showing an example of first handle section 10 and second handle section 12 in an intermediate position. Also shown by dotted lines are first handle section 10 and second handle section 12 in an adjacent position. First handle section 10 and second handle section 12 may have a channel shaped cross section to accommodate body 4 in a closed position. A channel shaped cross section is shown for illustration purposes only. Handle sections may take on any cross section that allows functions described here.

Figure 2:
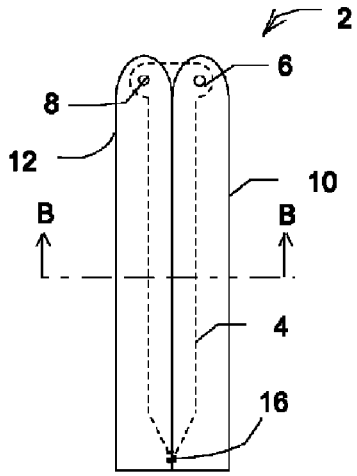
FIG. 2 is a front view of the folding pen of FIG. 1 in a closed position.

FIG. 2 shows pen 2 in a first closed position. First and second handle sections 10 and 12 have been moved about hinges 6 and 8 to their full extent to a first closed position adjacent to each other obscuring and covering body 4 including pen point 16, each depicted here as hidden by dotted lines. In the closed position pen point 16 is protected from accidental or unintended contact with material such as shirts or paper.

Figure 2A:
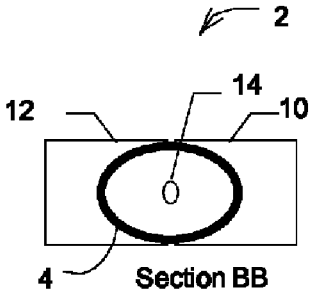
FIG. 2A is a cross section view of section BB of FIG. 2.

FIG. 2A shows a cross section BB of FIG. 2. FIG. 2A includes body 4, first handle section 10, second handle section 12 and reservoir 14. Pen 2 is in a closed and adjacent position with first handle section 10 and second handle section 12 covering and enclosing body 4.

Figure 3:
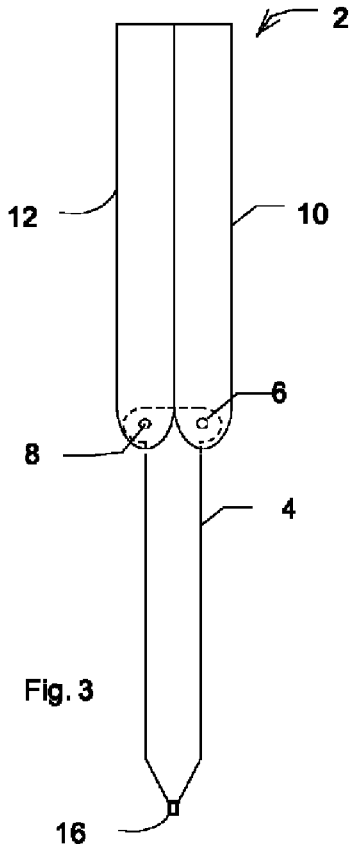
FIG. 3 is a front view of the folding pen of FIG. 1 in an open position.

FIG. 3 shows pen 2 in an open position. First and second handle sections 10 and 12 have been moved about hinges 6 and 8 to their full extent to a second open position adjacent to each other with body 4 and pen point 16 uncovered. First and second handle sections 10 and 12 in the open position form a grip section or an extension to body 4 and provide an additional portion for gripping and holding pen 2 while writing.

Pen 2 may include a feature to prevent handle section 10 and handle section 12 from moving beyond 180 degrees of rotation around hinges 6 and 8 from the closed position. FIG. 4 shows a portion of pen 2 with a pin 4C as a portion of body 4. Handle section 10 may have a first handle portion 10C configured to accept pin 4C in the open position. Handle section 12 may similarly have a second handle portion 12C configured to also accept pin 4C in the open position. With pen 2 in the open and adjacent position pin 4C may limit movement of body 4, handle section 10, and handle section 12 in relation to each other.

Figure 4A:
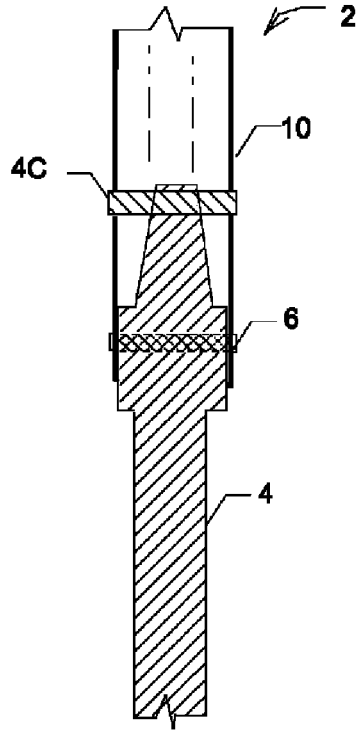
FIG. 4A is a cross section view of section CC of FIG. 4.
Figure 4:
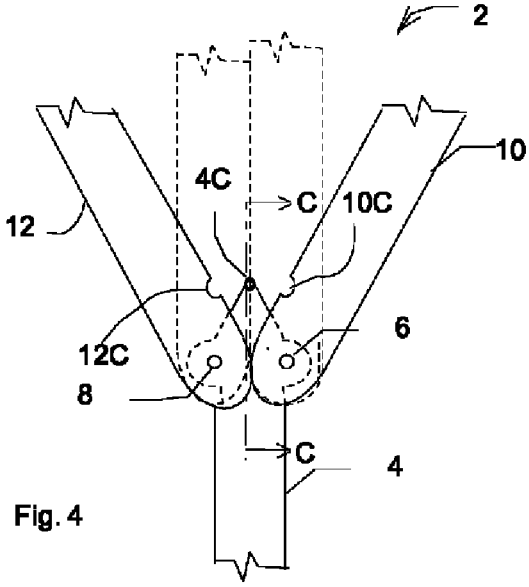
FIG. 4 is front view of a portion of the folding pen of FIG. 1 showing a pin as part of the folding pen body.

FIG. 4A shows a cross section CC of FIG. 4. FIG. 4A includes body 4, pin 4C, a portion of handle 10 and hinge 6 shown as partially hidden by dotted lines. Pin 4C is transverse to the longitudinal axis of body 4 and parallel to hinge 6. First handle section 10 receives pin 4C in the open and adjacent position. The configuration shown is an example and should not be considered a limitation. Pin 4C may be formed as part of the handle or may be a separate component fixed to the handle or any other configuration which functions in a similar manner.

Figure 4B:
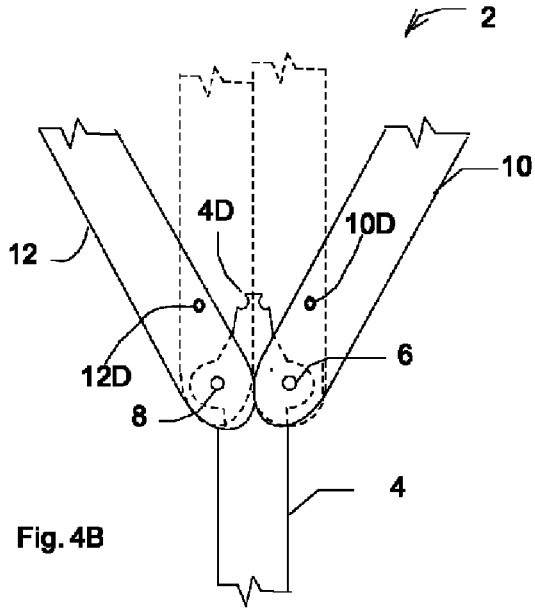
FIG. 4B is front view of a portion of the folding pen of FIG. 1 showing a stop as part of the folding pen body.

FIG. 4B shows a portion of pen 2 showing an alternate configuration of body 4. Body 4 may have a portion configured as a stop 4D. Handle section 10 may have a first transverse portion 10D configured to contact stop 4D. First transverse portion 10D may be a pin mounted transversely to the longitudinal axis of handle section 10 and parallel to first hinge 6 and second hinge 8. Transverse portion 10D may instead be a tab formed from the handle material or may have another configuration that acts in a similar manner. Handle section 12 may have a second transverse portion 12D corresponding and similar to first transverse portion 10D also configured to contact stop 4D. In moving to the fully open position, stop 4D of body 4 may receive first transverse portion 10D and second transverse portion 12D and movement of first handle section 10, second handle section 12, and body 4 may subsequently be limited in relation to each other.

Stop 4D of body 4 may be configured to receive transverse portions 10D and 12D as an interference fit. First transverse portion 10D and second transverse portion 12D may be frictionally retained by stop 4B in the open and adjacent position. To move first handle section 10 and second handle section 12 into the fully open adjacent position additional force may be applied to overcome the interference fit. To move first handle section 10 and second handle section 12 from the adjacent open position additional force may be applied to overcome the interference fit.

Body 4 may be configured to resemble a knife blade and pen 2 may resemble a butterfly knife. First handle section 10, second handle section 12 and/or body 4 may be curved rather than straight. Straight configurations are used here for the purpose of illustration only.

Figure 5:
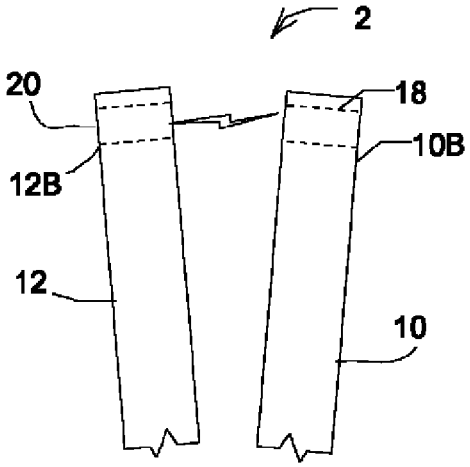
FIG. 5 shows a portion of the handle sections of the folding pen of FIG. 1 in a non-adjacent position with magnets for holding an adjacent position.

Folding pen 2 may include means to maintain first and second handle sections in the open or closed positions. FIG. 5 shows an example of a retention system. Folding pen 2 in this example is in an intermediate position with first handle section 10 and second handle section 12 not adjacent to each other. Non-hinged or distal end 10B of first handle section 10 may include a first magnet 18. Non-hinged or distal end 12B of second handle section 12 may include a second magnet 20.

Figure 5A:
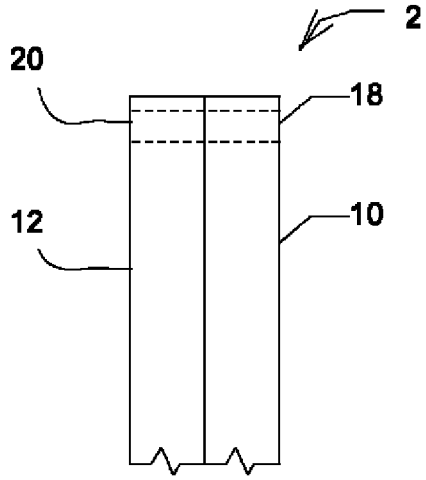
FIG. 5A shows the portion of the handle sections of FIG. 5 in an adjacent position with magnets holding the sections in the adjacent position.

FIG. 5A shows the handle sections of FIG. 5 in an adjacent position. When handle sections are adjacent to each other magnets 18 and 20 will also be adjacent and when arranged with opposite poles facing each other will exert an attracting force on each other. The magnetic force will maintain the handles in the adjacent position until a force is applied to separate first handle section 10 and second handle section 12. Magnets 18 and 20 will be adjacent with pen 2 in both the open and closed positions, acting similarly in both positions to maintain that position.

Figure 6:
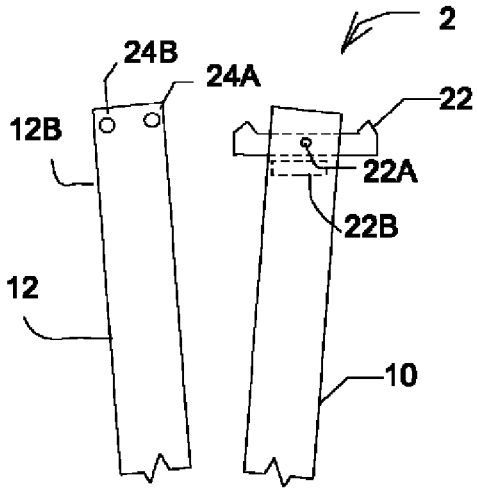
FIG. 6 shows a portion of the handle sections of the folding pen of FIG. 1 in a non-adjacent position with a latch for holding the handle sections in an adjacent position.

FIG. 6 shows another example of a system for maintaining handle sections in open and closed positions. Folding pen 2 in this example is in an intermediate position with first handle section 10 and second handle section 12 not adjacent to each other. First handle section 10 of folding pen 2 may include a latch 22 that pivots on a latch pin 22A with a spring mechanism 22B to maintain a preferred position for latch 22.

Folding pen 2 may further include a first pin 24A and a second pin 24B on second handle section 12. As first handle section 10 and second handle section 12 move to an adjacent position, latch 22 may deflect or rotate about latch pin 22A to engage pin 24A maintaining first handle section 10 in a position adjacent to second handle section 12 until released.

Figure 6A:
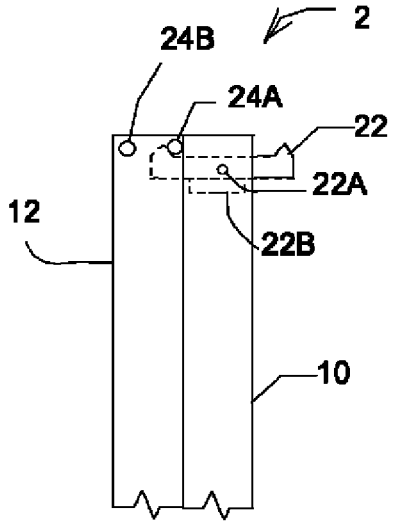
FIG. 6A shows the portion of the handle sections of FIG. 6 in an adjacent position with the latch holding the handle sections in the adjacent position.

FIG. 6A shows pen 2 with first handle section 10 and second handle section 12 of FIG. 6 in an adjacent position with one end of latch 22 engaging pin 24A. Latch 22 may be held in position by spring mechanism 22B to positively engage pin 24A until released by depressing the exposed end of latch 22 causing it to rotate about pin 22A. Latch 22 may similarly engage pin 24B when pen 2 is in the opposite adjacent position.

Figure 7:
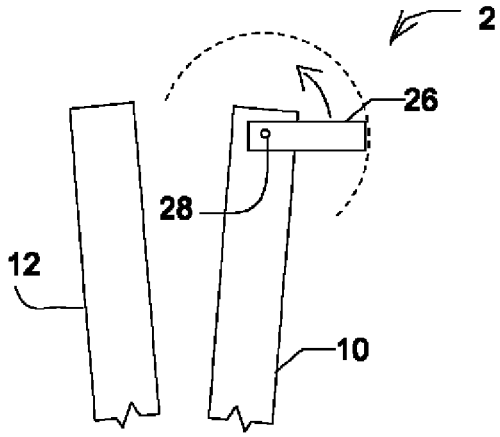
FIG. 7 shows a portion of the handle sections of the folding pen of FIG. 1 in a non-adjacent position with a bail for holding the handle sections in the adjacent position.
Figure 7A:
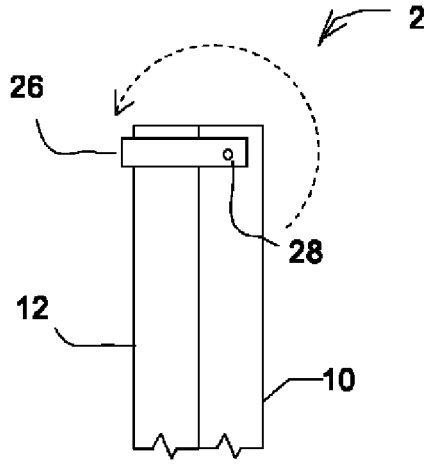
FIG. 7A shows the portion of the handle sections of FIG. 7 in an adjacent position with the bail holding the handle sections in the adjacent position.

FIG. 7 shows yet another example of a system for maintaining handle sections in open or closed positions. Folding pen 2 in this example is shown in an intermediate position with first handle section 10 and second handle section 12 not adjacent to each other. First handle section 10 may include a bail 26 retained by a pin 28 such that bail 26 pivots about pin 28. FIG. 7A shows folding pen 2 of FIG. 7 in an adjacent position with first handle section 10 and second handle section 12 adjacent to each other. On moving to adjacent positions first handle section 10 may be retained adjacent to second handle section 12 by rotating bail 26 about pin 28 so that bail 26 passes over the end of second handle section 12. Bail 26 may be retained in this position by detents that restrict movement of bail 26. Bail 26 may function with pen 2 in both the open and closed positions, acting similarly in both positions to maintain that position.

Bail 26 and pen 2 of FIG. 7 and 7A may be configured to operate automatically. Moving handle sections 10 and 12 to the open and adjacent position may cause bail 26 to automatically close over second handle section 12. Squeezing the handles while in the open position with bail 26 over second handle section 12, bail 26 in addition or instead may be configured to automatically release from handle section 12.

Figure 8:
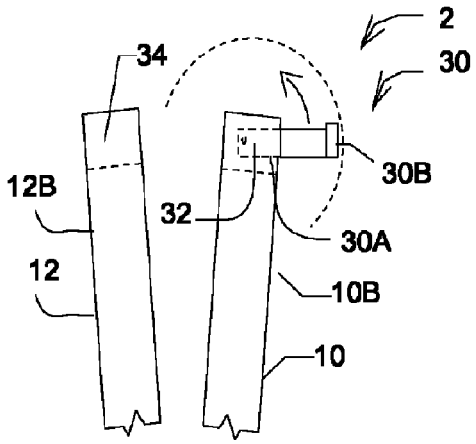
FIG. 8 shows a portion of the handle sections of the folding pen of FIG. 1 in a non-adjacent position with a hasp for holding the handle sections in the adjacent position.

FIG. 8 shows another example of a system for maintaining handle sections in open or closed positions. Folding pen 2 in this example is shown in an intermediate position with first handle section 10 and second handle section 12 not adjacent to each other. First handle section 10 may include a hasp 30 attached to first handle section 10 by a pin 32 allowing hasp 30 to pivot about pin 32. Hasp 30 may have a tee shape with a narrow proximal section 30A near pin 32 and a broader distal section 30B away from pin 32. Second handle section 12 may have a slot 34 in distal end 12B. On moving to adjacent positions first handle section 10 may be retained adjacent to second handle section 12 by rotating hasp 30 about pin 32 so that the narrow portion of hasp 30 passes into slot 34.

Figure 8A:
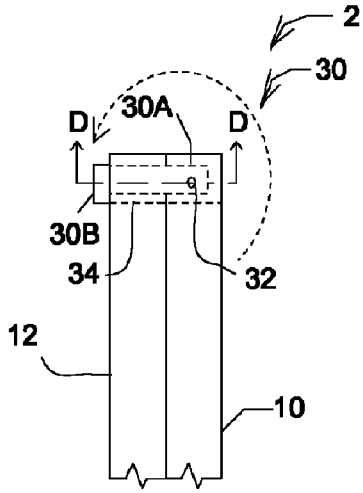
FIG. 8A shows a portion of the handle sections of FIG. 8 in an adjacent position with the hasp holding the handle sections in the adjacent position.

FIG. 8A shows first handle section 10 and second handle section 12 in a closed and adjacent position. Hasp 30 has been rotated about pin 32 to position hasp 30 in slot 34 of second handle section 12. Hasp 30 may be retained in this position by detents that restrict movement of hasp 30.

Figure 8B:
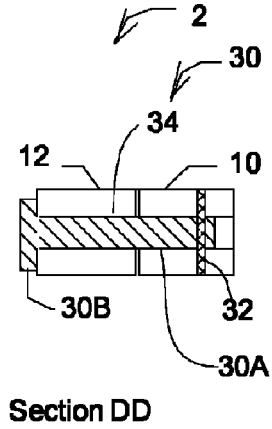
FIG. 8B shows a cross section view of section DD of FIG. 8A with the hasp holding the handle sections in the adjacent position.

FIG. 8B shows a cross section of folding pen 2 section DD of FIG. 8A. FIG. 8B includes first handle section 10 and second handle section 12 in an adjacent position, hasp 30 and pin 32. Narrow portion 30A is in slot 34. Broad section 30B of hasp 30 retains second handle section 12 and maintains folding pen 2 in the adjacent position. Hasp 30 may include a spring that biases hasp 30 to a preferred position. Hasp 30 may function with pen 2 in both the open and closed positions, acting similarly in both positions to maintain that position.

Hasp 30 and pen 2 of FIG. 8 and 8A may be configured so that moving the handle sections to the open and adjacent position may cause hasp 30 to automatically move into slot 34 of second handle section 12. In addition or instead, squeezing the handles together while in the open position with hasp 30 in slot 34 may automatically release hasp 30 from slot 34.

Figure 9:
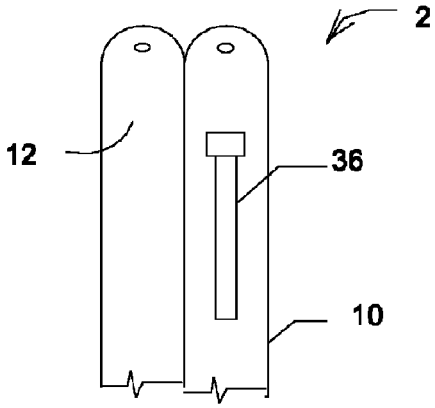
FIG. 9 is a front view of a portion of the handle sections of the folding pen of FIG. 1 including a clip for attaching the pen to an object.

FIG. 9 is a front view of folding pen 2 including a clip 36 for attaching pen 2 to a shirt or other object. Clip 36 may be configured as a spring or may have another configuration that allows pen 2 to be frictionally attached to clothing or other thin object such as a notebook page. Clip 36 may flex but may be biased to return to an original position.

Figure 9A:
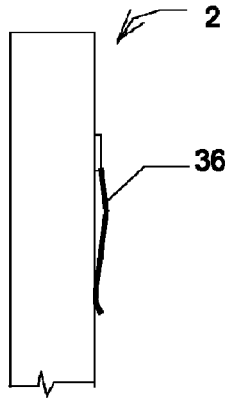
FIG. 9A is a side view of a portion of the handle sections of FIG. 9 showing the clip for attaching the pen to an object.

FIG. 9A is a side view of folding pen 2 including clip 36. This configuration is an example and any clip which serves to affix pen 2 to another object falls within the scope of this disclosure.

The above described system and assemblies are examples and are not to be used as limitations. Any suitable configuration or combination of components presented, or equivalents to them that perform a similar function, may also be used.

While embodiments of a folding pen and methods of use have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized.

Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A folding pen comprising:

a body with a distal end and a proximal end; and a first hinge at the distal end;

a second hinge adjacent to the first hinge at the distal end; and a pen point for writing extending from the body at the proximal end;

a first handle section with a proximal end and a distal end; and a second handle section with a proximal end and a distal end;

where the first handle section proximal end is connected to the body at the first hinge and the second handle section proximal end is connected to the body at the second hinge;

where the first handle section pivots about the first hinge and the second handle section pivots about the second hinge moving between a closed position with the first and second handle sections covering the body and an open position with the first and second handle sections forming a grip portion.

2. The folding pen of claim 1 where the first handle section distal end includes a first magnet and the second handle section distal end includes a second magnet.

3. The folding pen of claim 1 where the first handle section distal end includes a latch and the second handle section distal end includes at least one pin where with the first handle section and the second handle section adjacent, the latch engages the at least one pin to fix the handle sections in an adjacent position.

4. The folding pen of claim 1 where the first handle section distal end includes a bail and the second handle section is retained in an adjacent position to the first handle section when the bail is passed over the second handle section distal end.

5. The folding pen of claim 1 where the first handle section distal end includes a hasp with a wide portion and a narrow portion, where the narrow portion may be inserted into a slot in the second handle distal end to retain the second handle in an adjacent position to the first handle section.

6. The folding pen of claim 1 where the body distal end includes a stop configured to contact a first transverse portion of the first handle section and a second transverse portion of the second handle section in the open and adjacent position to limit movement of the first handle section, the second handle section and the body in relation to each other.

7. The folding pen of claim 1 where the body distal end includes a pin configured to contact a first handle portion of the first handle section and a second handle portion of the second handle section in the open and adjacent position to limit movement of the first handle section, the second handle section and the body in relation to each other.

8. The folding pen of claim 6 where the stop is configured to frictionally retain the first and second handle sections in the open and adjacent position.

9. The folding pen of claim 1 further including a clip configured to frictionally attach the folding pen to a thin material.

10. A folding pen comprising:

an elongate body with a pen point for dispensing ink from a reservoir at a first end and a first hinge and a second hinge at a second end;

a left handle section attached to the elongate body by the first hinge; and a right handle section attached to the elongate body by the second hinge;

where the right handle section pivots about the first hinge and the left handle section pivots about the second hinge moving between;

a first position with the right and the left handle sections adjacent to each other obscuring the elongate body; and a second position with the right and the left handle sections adjacent to each other exposing the elongate body and the pen point.

11. The folding pen of claim 10 where the right handle section includes a first magnet and the left handle section includes a second magnet configured to bias the right and the left handle sections to an adjacent position.

12. The folding pen of claim 10 where the right handle section includes a latch and the left handle section includes at least one pin where with right handle section and the left handle section are adjacent, the latch engages the at least one pin to maintain the right and left handle sections in the adjacent position.

13. The folding pen of claim 10 where the right handle section includes a bail and the left handle section is retained in an adjacent position when the bail is passed over the left handle section.

14. The folding pen of claim 10 where the first handle section includes a hasp with a wide portion and a narrow portion, where the narrow portion fits into a slot in the second handle to maintain the second handle in an adjacent position to the first handle section.

15. The folding pen of claim 10 further including a clip configured to frictionally attach the folding pen to a thin material.

16. The folding pen of claim 10 where the elongate body second end includes a stop configured to contact a first transverse portion of the left handle section and a second transverse portion of the right handle section in the open and adjacent position to limit movement of the left handle section, the right handle section and the elongate body in relation to each other.

17. The folding pen of claim 10 where the elongate body second end includes a pin configured to contact a first handle portion of the left handle section and a second handle portion of the right handle section in the open and adjacent position to limit movement of the the left handle section, the right handle section and the elongate body in relation to each other.

18. The folding pen of claim 16 where the stop is configured to frictionally retain the left and right handle sections in the open and adjacent position.

* * * * *